US007412945B2

(12) United States Patent
Jekerle et al.

(10) Patent No.: US 7,412,945 B2
(45) Date of Patent: Aug. 19, 2008

(54) WASTE HEAT BOILER

(75) Inventors: Jiri Jekerle, Baunatal (DE); Heinrich Ormann, Baunatal (DE); Klaus Rothenpieler, Kassel (DE)

(73) Assignee: ALSTOM Technology Ltd., Baden (DE)

( * ) Notice: Subject to any disclaimer, the term of this patent is extended or adjusted under 35 U.S.C. 154(b) by 76 days.

(21) Appl. No.: 11/605,608

(22) Filed: Nov. 29, 2006

(65) Prior Publication Data

US 2007/0125317 A1 Jun. 7, 2007

(30) Foreign Application Priority Data

Dec. 1, 2005 (DE) ..... 10 2005 057 674

(51) Int. Cl.
*F22B 1/18* (2006.01)

(52) U.S. Cl. ..... 122/7 R; 165/101

(58) Field of Classification Search ..... 122/7 R, 122/31.1, 32; 165/101, 110, 115, 118
See application file for complete search history.

(56) References Cited

U.S. PATENT DOCUMENTS

| | | | | |
|---|---|---|---|---|
| 447,285 | A * | 3/1891 | Alberger | 165/101 |
| 1,918,966 | A * | 7/1933 | Harkness | 165/101 |
| 3,477,411 | A * | 11/1969 | Gething | 122/7 R |
| 4,993,367 | A * | 2/1991 | Kehrer | 122/7 R |
| 5,452,686 | A * | 9/1995 | Stahl | 122/135.1 |
| 5,852,990 | A * | 12/1998 | Primdahl | 122/7 R |

FOREIGN PATENT DOCUMENTS

| | | |
|---|---|---|
| DE | 28 46 455 | 10/1979 |
| DE | 28 46 455 B1 | 10/1979 |
| DE | 39 13 422 A1 | 10/1990 |
| EP | 0 356 648 A1 | 6/1989 |
| EP | 0 356 648 A1 | 3/1990 |
| EP | 1 498 678 A1 | 1/2005 |

OTHER PUBLICATIONS

German Search Report 10 2005 057 674.5-16, dated Jul. 14, 2006.

* cited by examiner

*Primary Examiner*—Gregory A Wilson
(74) *Attorney, Agent, or Firm*—Alix, Yale & Ristas, LLP

(57) ABSTRACT

A waste heat boiler includes an axial bypass pipe and multiple heat transfer pipes disposed within a cylindrical jacket. A hot exhaust gas stream transported between inlet and outlet ends of the heat transfer pipes is cooled by a coolant. A control system controls gas passage velocity and quantity of the exhaust gas stream through the bypass pipe whereby the exhaust gas stream exhaust temperature is maintained within a predetermined temperature range. The control system includes a stopper disposed at the outlet end of the bypass pipe and has a head plate extending into the outlet end of the bypass pipe. The stopper is axially displaceable from a closed position, where an outer surface of the stopper head plate contacts an inner surface of the bypass pipe outlet end. The gas passage formed between the inner surface of the bypass pipe outlet end and the outer surface of the stopper head plate has a cross-section that increases as the stopper is axially displaced from the closed position. The stopper is cooled by a cooling medium.

12 Claims, 5 Drawing Sheets

WASTE HEAT BOILER

BACKGROUND

The invention relates to a waste heat boiler that comprises, within a cylindrical jacket, a multiplicity of heat transfer pipes and a centrally arranged bypass pipe, each of which has an inlet end and an outlet end, and that comprises a control device to maintain the waste heat boiler gas exhaust temperature within a particular temperature range. The invention relates, in particular, to a waste heat boiler, the control device of which attaches to the outlet end of the bypass pipe in order to influence the waste heat boiler gas exhaust temperature.

Waste heat boilers that are fed on the pipe- and jacket side (channel side) with various gaseous and/or liquid mediums are used in numerous chemical and petrochemical processes. In the process, the hot exhaust gas that develops as a result of a process is fed to the heat transfer pipes, which are arranged as a pipe bundle within the waste heat boiler jacket, as well as to the bypass pipe. While passing through the heat transfer pipes, the hot exhaust gas transfers its heat to the cooling medium, generally water, on the jacket side and is subsequently removed from the waste heat boiler in a cooled state. In order to maintain the waste heat boiler gas exhaust temperature within a particular temperature range, it may be necessary to influence the exhaust temperature with the help of a controlled bypass. This may, for example, be accomplished by using a control damper or a rotating control damper or a control stopper that is arranged at the outlet end of the bypass pipe. Such control devices are known from printed publications DE AS 28 46 455 and EP 0 356 648 A1.

Because the exhaust gases in the bypass pipe of the waste heat boiler have a very high temperature and in the large majority of cases flow through at a high velocity, a control element such as a control damper or a control stopper that is arranged at the outlet end of the bypass pipe is subject to high thermal load. The control stoppers currently in use have the disadvantage that exhaust gases that flow out the outlet end of the opened bypass pipe form a powerful plume so that there is a danger of hot spots on the wall of the gas exhaust chamber. One or several of these hot spots cause thermal damage to the wall of the gas exhaust chamber, which in turn leads to undesirably short servicing intervals or to a shorter life span of the waste heat boiler.

SUMMARY

The object of the present invention is to create a control stopper that, on the one hand, is able to withstand the high exhaust gas temperatures, and on the other, to avoid the formation of hot plumes when the exhaust gases exit from the bypass pipe outlet end.

The aforementioned object is solved by the totality of the characteristics of patent claim 1. The solution provides that the stopper may be cooled by a cooling medium, and that it extends into the cone-shaped outlet end of the bypass pipe, viewed in the direction of gas flow, and the gas passage cross-section expands uniformly or non-uniformly in the direction of flow of the exhaust gas flow within the gas passage area that is between the inner surface of the outlet end and the outer surface of the stopper and independently of the position of the stopper that is in the opened position.

Advantageous embodiments of the invention may be derived from the sub-claims.

As a result of the solution, according to the invention, a waste heat boiler is created that has the following advantages:

- by avoiding the hot plumes as the exhaust gases exit, the wall of the gas exhaust chamber remains undamaged, and the life span of the waste heat boiler is increased. In addition, servicing intervals may be increased;
- as a result of the cooling of the stopper, thermal corrosion to the stopper is avoided, and the functionality and life span of the control element is significantly improved or increased, as the case may be.

Advantageously, the stopper, viewed in the flow direction of the exhaust gas stream, is implemented with a stopper base plate that extends radially opposite the center portion of the stopper to deflect the exhaust gas stream in a maximally radial direction. By deflecting the hot exhaust gas stream, it is fed in an approximately orthogonal direction toward the cooled exhaust gas flowing out of the heat transfer pipes and intermingled with it, and potentially present gas plumes are dissipated in the hot exhaust gas stream. In order to achieve reliable deflection of the hot exhaust gas stream of approximately 90°, the external diameter Dt of the stopper base plate must be at least a 1.5 times the external diameter Dk of the stopper head plate.

In an advantageous embodiment of the invention, the outer surface of the center portion of the stopper exhibits at least partially a cylindrical area along its length. In connection with the conically expanded outlet end of the bypass pipe, viewed in the direction of the exhaust gas flow, the cylindrical area of the stopper results in a technically, almost maximally advantageous, cross-sectional expansion of the gas passage area, which amounts to a high diffuser effect with a concomitantly large deceleration in gas velocity.

Advantageously, the outer surface of the center portion of the stopper exhibits at least partially along its length a conic area, whereby particularly advantageously the taper of this conic area of the center portion of the stopper corresponds to the taper of the cone-shaped outlet end of the bypass pipe. With the quasi-parallel formation of the inner surface of the bypass pipe outlet end and the conic area of the outer surface of the center portion of the stopper, a diffuser effect with deceleration in exhaust gas velocity is achieved by the enlargement of the cross-section of the gas passage in the direction of the gas stream (the radial dimensions of the cross-section of the circular ring increase in the direction of gas flow, and, therefore, also the diameter of the circular ring itself).

The diffuser effect and therewith the deceleration in exhaust gas velocity can be increased in that the taper of at least one area of the conic center portion of the stopper deviates in relation to the taper of the cone-shaped outlet end of the bypass pipe, whereby the taper of this area in relation to the taper of the outlet end of the bypass pipe diverges, viewed in the flow direction of the exhaust gas stream.

An advantageous embodiment provides that the stopper shaft that is connected with the stopper may be cooled by means of a cooling medium, and that the cooling medium may be fed toward the stopper via the stopper shaft. By this means, it is achieved that the stopper shaft suffers no heat damage, and that the cooling medium is fed toward the stopper in a simple manner in design and structural terms. In the process, the stopper and/or the stopper shaft may be configured so that it cools in one direction such that the cooling medium exits out of the shaft end or the stopper after being fed there through and enters into the exhaust gas stream that is flowing past. This configuration results in a solution that is simple in design and structural terms, whereby the cooling medium that enters the exhaust gas stream further cools the hot exhaust gas stream and is simultaneously removed.

In order to avoid overheating and corrosion at the outlet end of the bypass pipe, the conic outlet end of the bypass pipe is advantageously provided with a lining on its interior side. In an advantageous embodiment, the bypass pipe has a larger internal diameter than do the heat transfer pipes in order to bypass a correspondingly high quantity of exhaust gas.

An advantageous embodiment of the invention provides that the guiding device that feeds the cooling medium through the stopper and/or the shaft is adapted to the exterior wall of the stopper and/or the stopper shaft such that a gap is created between the exterior wall and the guiding device through which the cooling medium is fed.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
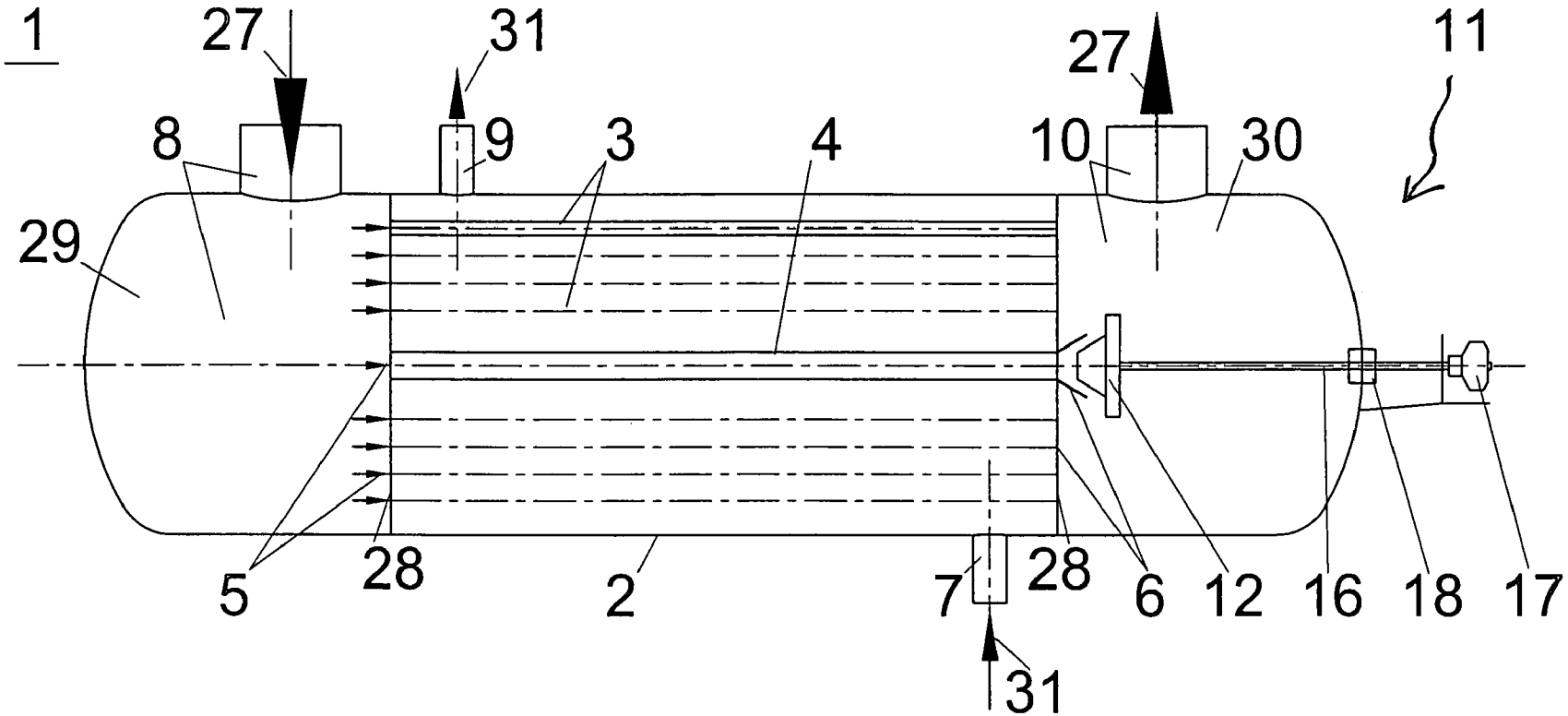
FIG. 1 is a schematic longitudinal sectional view through a waste heat boiler.

FIG. 1 shows a waste heat boiler 1 schematically represented in longitudinal section. Such waste heat boilers 1 are needed for the most varied and chemical and petrochemical processes. The waste heat boiler 1 has an outer jacket 2, which encloses a multiplicity of heat transfer pipes 3, and a centrally arranged bypass pipe 4, whereby pipes 3, 4 are enclosed at their inlet and outlet ends 5, 6 by pipe endplates 28 such that a hollow space for passing the cooling medium 31 for cooling the hot exhaust gas stream 27 is formed between the jacket 2 and the endplates 28. The bypass pipe 4, which preferably has a larger diameter than the heat transfer pipes 3, may be thermally insulated either partially or completely along its length in order to allow hot exhaust gas 27 to flow through with the waste heat boiler 1 without dissipating significant heat to the cooling medium 31. Viewed in the direction of the flow of the exhaust gas 27, i.e., parallel to the longitudinal axis of the waste heat boiler 1, a device 8 for introducing the hot exhaust gas stream 27 is provided upstream from the inlet end 5 of pipes 3, 4, and a device 10 for removing the cooled exhaust gas stream 27 is provided downstream from the outlet end 6 of the pipes 3, 4, whereby each of the devices 8, 10 has at least one gas admission and one gas exhaust chamber 29, 30. On the jacket side, the waste heat boiler 1 has devices 7 for introducing a cooling medium 31, preferably water, as well as devices 9 for removing the cooling medium 31, preferably water/steam. Within the area of the jacket, i.e., within the area of the heat transfer pipes 3, there occurs between the exhaust gas 27 which is fed through the heat transfer pipes 3 and the introduced water or cooling medium 31, as the case may be, an indirect heat exchange, whereby the hot exhaust gas 27 dissipates heat to the cooling medium 31.

At the outlet end 6 of the bypass pipe 4, an axially adjustable stopper 12 is engaged by a control device 11. The control device 11, which axially adjusts the stoppers 12 by means of a stopper shaft 16 that is connected with the stopper 12, comprises a drive 17 arranged outside the waste heat boiler 1. For the purpose of sealing the gas, the passage of the stopper shaft 16 through the wall of the gas exhaust chamber 30 is sealed with a bushing 18. The stopper 12 at the outlet end 6 of the bypass pipe 4 can be adjusted by means of the control device 11 such that a desired temperature or a desired temperature range of the exhaust gas 27 can be maintained or sustained at the outlet of the waste heat boiler 1. This is always necessary when the heat transfer coefficient is reduced because of dirt on the interior wall of the heat transfer pipes 3, and the exhaust gas temperature increases as a consequence at the outlet. In this case, the bypass pipe 4 and the control stopper 12 that is located at its outlet end 6 engage, and the exhaust gas outlet temperature of the waste heat boiler 1 is influenced by a decrease or increase in the quantity of the exhaust gas stream. Axial displacement of the stopper 12 is associated with a change in gas velocity within the outlet end 6 area and the stopper 12.

In addition to very high gas exhaust velocities, gas plumes also develop at the outlet end 6 of the bypass pipe 4, which cause hot spots on the walls of the gas exhaust chamber 30, the outlet end 6 of the bypass pipe 4 is formed in an expanding cone shape, viewed in the flow direction of the exhaust gas stream 27. In connection with this measure, the stopper 12 is, according to the invention, implemented to be cooled by a cooling medium 32, and it extends into the cone-shaped expanded outlet end 6 of the bypass pipe 4, whereby the ring-shaped gas passage cross-section 22 that is formed by the inner surface 19 of the outlet end 6 of the bypass pipe 4 and the outer surface 20 of the stopper 12 expands uniformly or non uniformly within the gas passage area 21 viewed in the direction of gas flow. As a result, the expansion of the ring-shaped gas passage cross-section 22 within the gas passage area 21 is independent of the position of the stopper 12, which is in the opened position. The gas passage area 21 that has a gas passage cross-section 22, which, in relation to the bypass pipe 4, extends in an axial direction and the length Ld of which is determined by the position of the stopper 12 within the outlet end 6 of the bypass pipe 4, is defined as the area 21 at which, viewed in the direction of the gas flow, the inner surface 19 of the bypass pipe outlet end 6 and the outer surface 20 of the stopper 12 overlap or intersect, as the case may be. The stopper 12 is arranged such that it must be coaxial to the bypass pipe 4 or its outlet end 6. The conic outlet end 6 of the bypass pipe 4 can, as represented in FIGS. 2 to 5, be implemented with a lining 26 along its internal diameter in order to protect the bypass pipe outlet end 6 from heat corrosion and from erosion.

When the bypass pipe 4 is closed (not depicted) the edge of the head plate 13 of the stopper 12 touches the cone of the bypass pipe 4 or its outlet end 6, and in the process the stopper 12 completely closes off the gas passage cross-section 22 of the bypass pipe 4 or its outlet end 6. When the bypass pipe 4 is opened by axially displacing the stopper 12 from the bypass pipe 4 or from its outlet end 6, a gas passage cross-section 22 develops, as is evident in FIG. 5, between the edge of the head plate 13 or the outer surface 20 of the stopper 12, as the case may be, and the cone-shaped inner surface 19 of the outlet end 6 of the bypass pipe 4, through which the hot exhaust gas flows out at a high velocity. The outer surface 20 of the stopper 12 has a conic area 24 at the center portion 14 of the stopper 12, which corresponds to the taper of the cone-shaped outlet end 6 of the bypass pipe 4. Through the conic expansion of the bypass pipe outlet end 6 and the stopper center portion 14, viewed in the direction of gas flow, their radial dimensions increase simultaneously in cross-section, which results in a continuous increase in the gas passage cross-section 22, viewed in the direction of the gas flow. This is synonymous with a diffuser effect—because of a cross-section that enlarges—in the gas passage area 21 between the bypass pipe outlet end 6 and the stopper 12. This achieves, according to the invention, that the high gas velocity of the exhaust gas 27 that is fed through the gas passage area 21 is reduced and decompressed. In the process, gas plumes that are present are also decompressed and dissipated.

Figure 3:
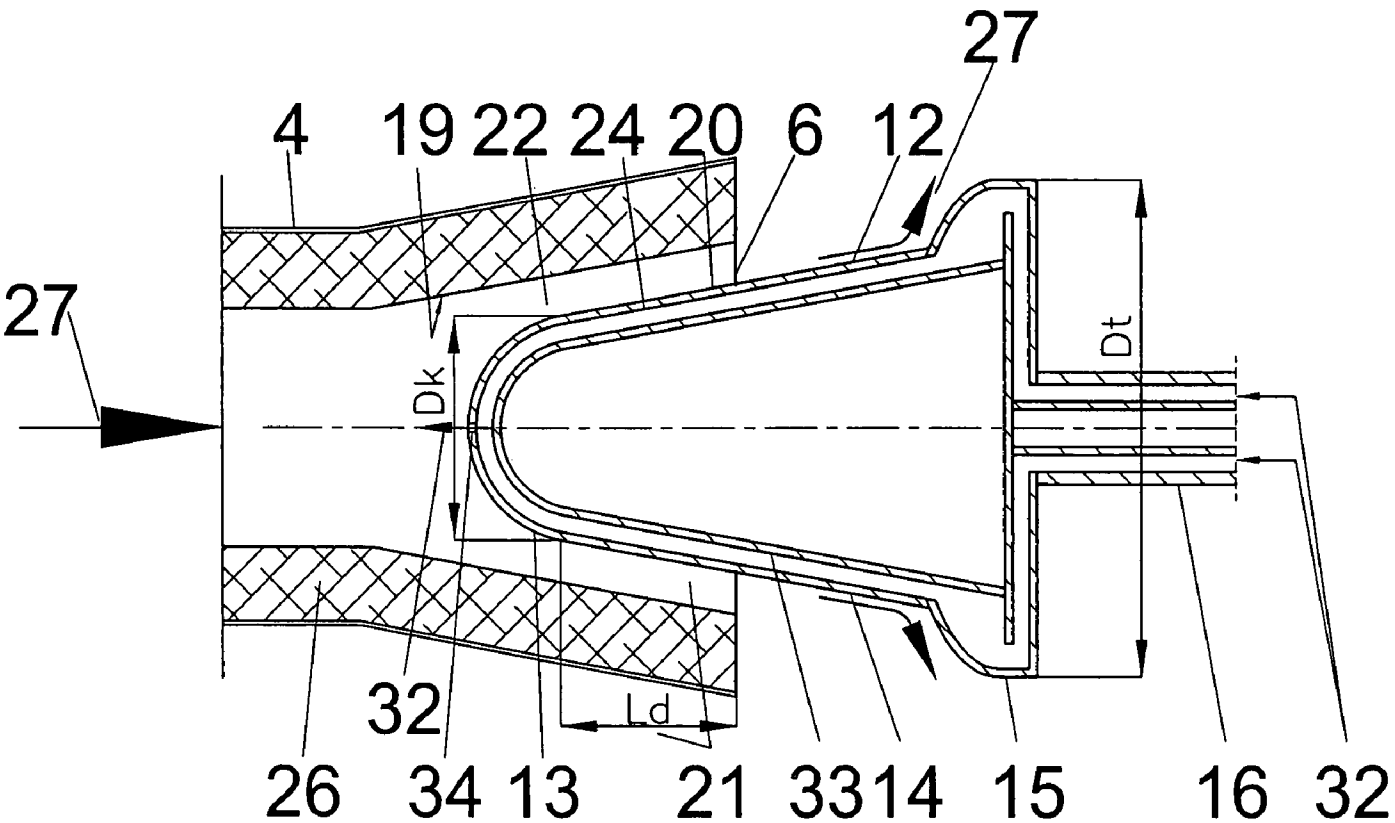
FIG. 3 is a longitudinal sectional view through the outlet end of the bypass pipe of the waste heat boiler of FIG. 1, the exhaust gas outlet temperature of which is controlled by a second embodiment of a stopper disposed at the outlet end of the bypass pipe.
Figure 4:
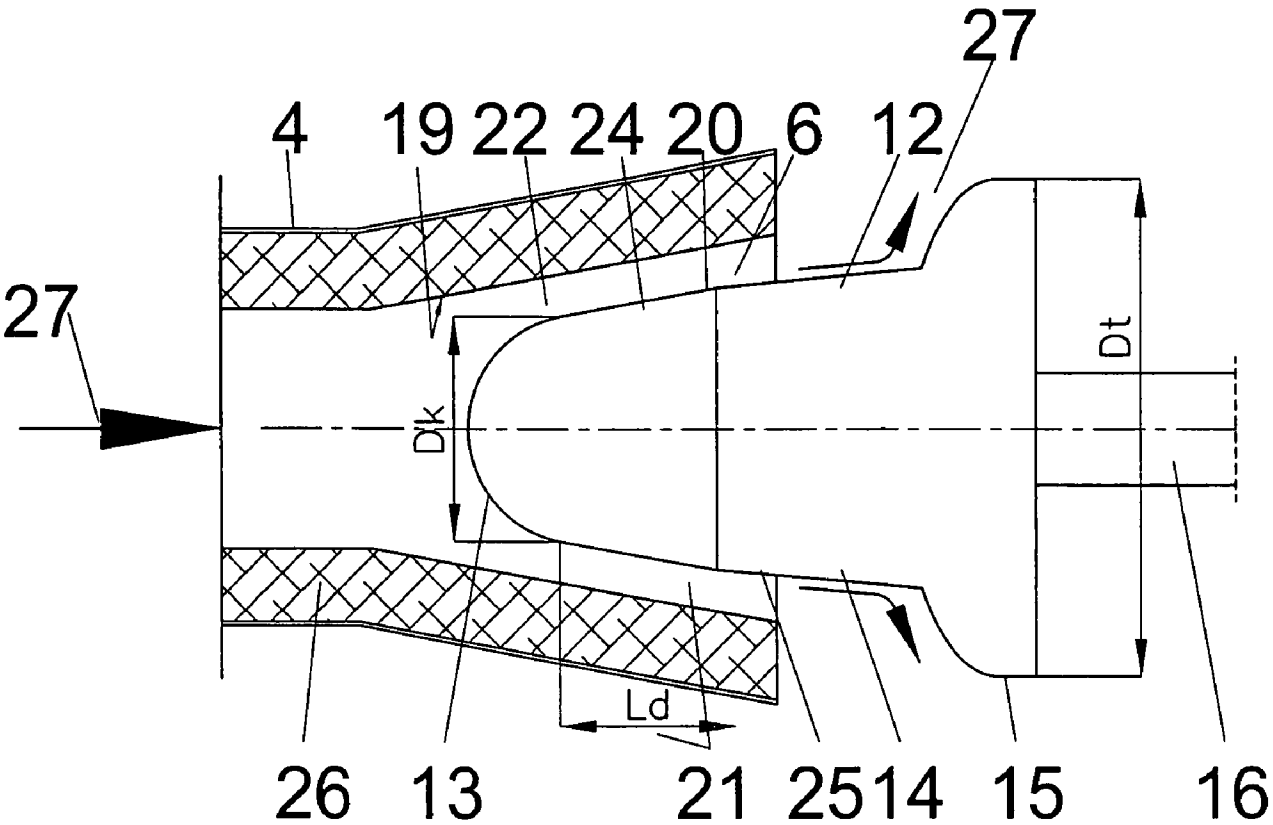
FIG. 4 is a longitudinal sectional view through the outlet end of the bypass pipe of the waste heat boiler of FIG. 1, the exhaust gas outlet temperature of which is controlled by a third embodiment of a stopper disposed at the outlet end of the bypass pipe.
Figure 5:
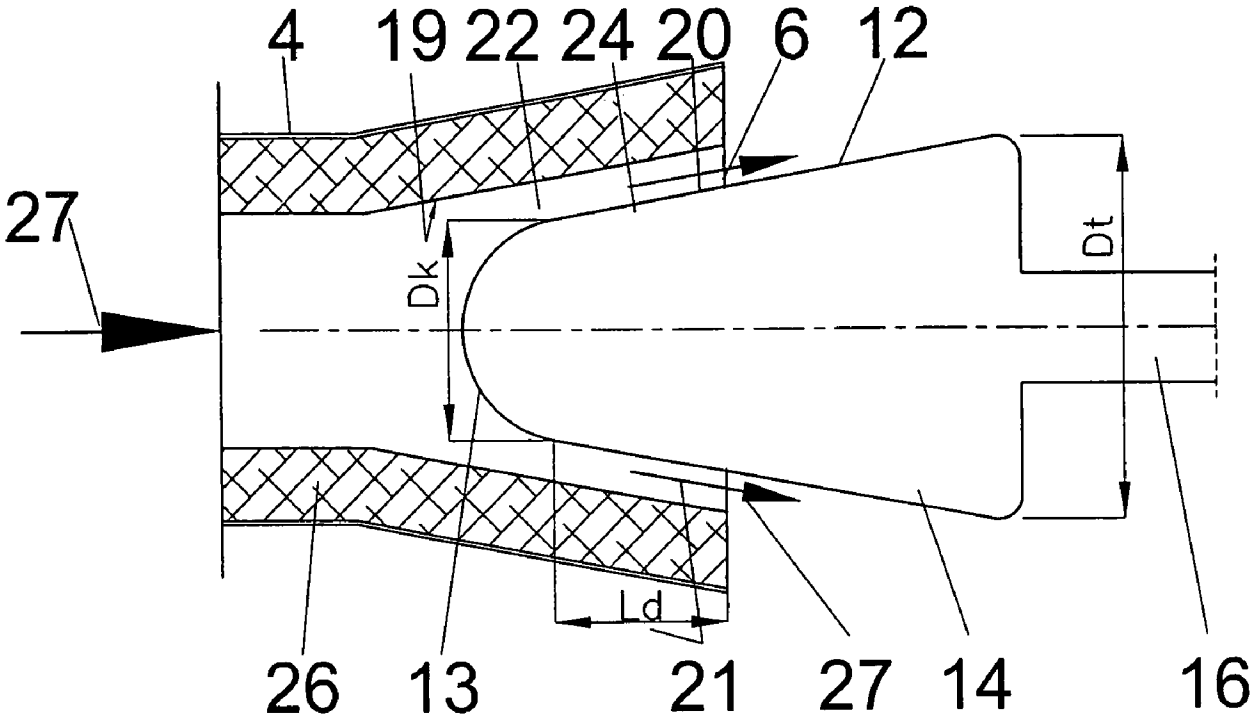
FIG. 5 is a longitudinal sectional view through the outlet end of the bypass pipe of the waste heat boiler of FIG. 1, the exhaust gas outlet temperature of which is controlled by a fourth embodiment of a stopper disposed at the outlet end of the bypass pipe.

FIG. 4 shows a further variant of a stopper 12 implemented according to the invention, the stopper center portion 14 of which is conically implemented. Viewed in the direction of gas flow, the conic area 24 of the upstream stopper center portion 14 here corresponds to the cone of the bypass pipe outlet end 6, and the conic area 25 of the downstream stopper center portion 14 deviates from the cone of the bypass pipe outlet end 6, whereby the taper of the area 25 in relation to the taper of the outlet end 6 of the bypass pipe 4, viewed in the direction of gas flow, runs divergently. In this embodiment, the gas passage cross-section 22 within the gas passage area 21 is non-uniformly expanded because the cross-section 22 expands more strongly in the conic area 25 than in the conic area 24, so that the diffuser action is increased in the conic area 25, and the exhaust gas velocity within the gas passage area 21 can be even more decompressed. Alternatively to the implementation according to FIG. 4, the conic area 25 of the stopper center portion 23 can be arranged upstream in relation to the conic area 24 of the stopper center portion 23. The gas passage cross-sections 22 within the gas passage areas 21 according to FIGS. 2, 3, and 5 have uniform expansions.

Figure 2:
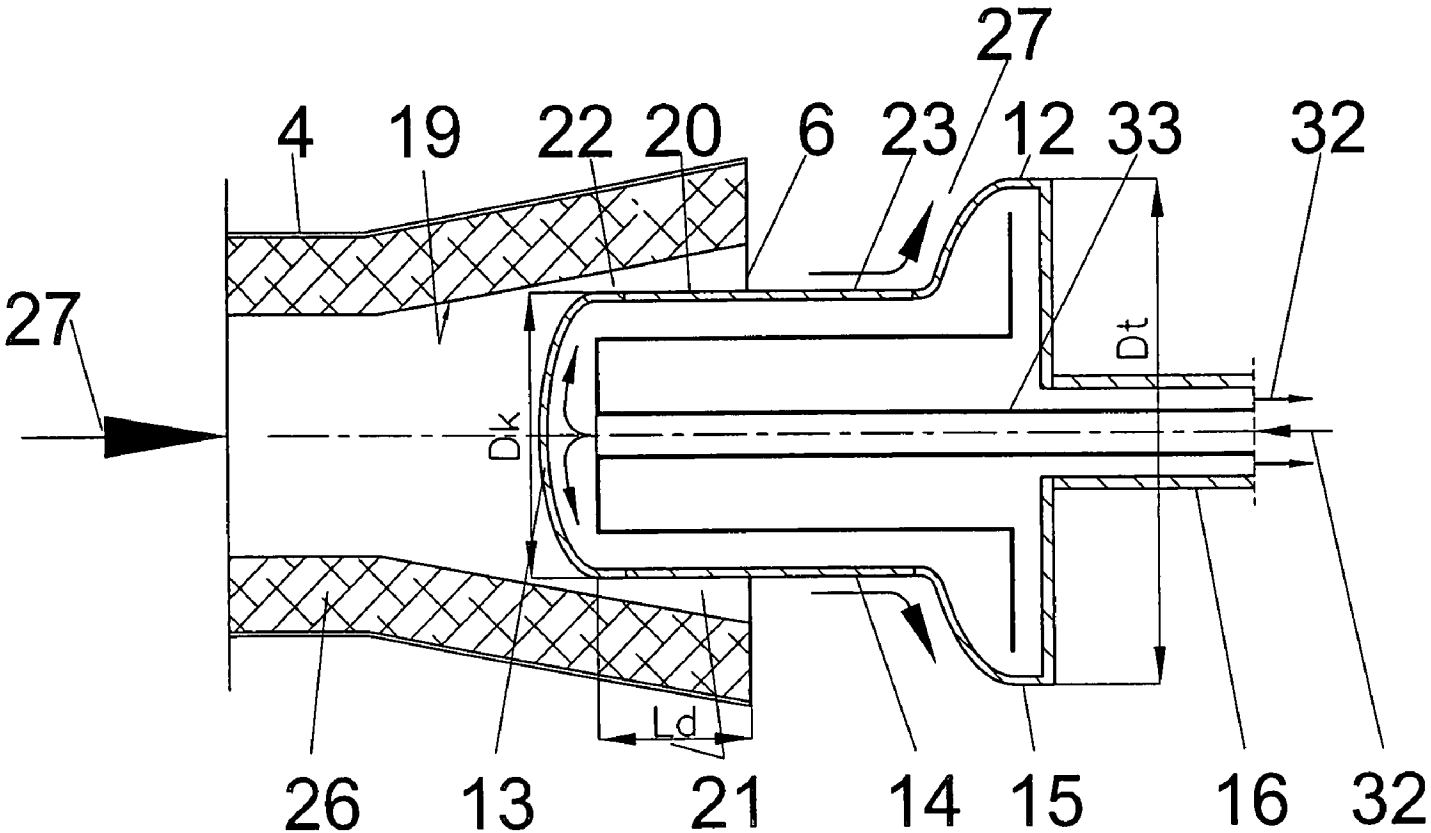
FIG. 2 is a longitudinal sectional view through the outlet end of the bypass pipe of the waste heat boiler of FIG. 1, the exhaust gas outlet temperature of which is controlled by a first embodiment of a stopper disposed at the outlet end of the bypass pipe.

A further variant of an implemented stopper 12 according to the invention is shown in FIG. 2, in which the stopper center portion 14 has a cylindrical area 23. This variant is characterized by a high diffuser effect within the gas passage area 21, because in the increasing gas passage cross-section 22, viewed in the direction of the gas flow, the gas velocity can be greatly reduced.

Any residual gas plumes in the hot exhaust stream that may potentially be present at the outlet of the outlet end 6 of the bypass pipe 4 may be dissipated by deflecting this gas stream by approximately 90° and by largely orthogonal introduction into the cooled exhaust gas stream that exits from the outlet ends 6 of the heat transfer pipes 3. The deflection is accomplished by means of a stopper base plate 15 arranged at the downstream end of the stopper 12, viewed in the direction of gas flow. This accomplishes that the exhaust gas stream that exits between the bypass pipe outlet end 6 and the stopper 12 and is directed toward the base plate 15 is deflected thereby by approximately 90° in a radial direction. By introducing the hot exhaust gas from the bypass pipe 4 into the cooled exhaust gas that exits from the outlet end 6 of the heat transfer pipe 3, intensive mixing of cold and hot exhaust gases occurs, and gas plumes that may potentially be present are dissipated in the process. According to FIGS. 2, 3, and 4, the stopper base plate 15 has an external diameter Dt that is preferably at least 1.5 times the external diameter Dk of the stopper head plate 13.

In addition to the stopper 12, the stopper shaft 16 that is connected to the stopper 12 is preferably also cooled by a cooling medium or fluid 32, as the case may be, generally water, whereby the cooling medium 32 fed to the stopper 12 is first directed through the shaft 16 and after flowing through the stopper 12 is again fed out through the shaft 16, as indicated in FIG. 2 by the arrows. By means of a guiding device 33, the cooling medium 32 can, as represented in FIG. 2 for example, be fed centrally, i.e., within the guiding device 33, deflected within the stopper 12, and subsequently removed via the shaft 16 in a concentric ring cross-section that is formed by the guiding device 33 and the external wall of the shaft 16.

FIG. 3 shows one-way cooling of stoppers 12 and stopper shaft 16 by a cooling medium 32, whereby one-way means that although the cooling medium 32 is fed to the stopper 12 via the shaft, it is not removed via the shaft 16. Removal is accomplished by exhausting the cooling medium 32, for example at one opening 34 of the head plate 13 of the stopper 12, whereby the cooling medium 32 is introduced into the exhaust gas stream 27 that is flowing past. The guiding device 33 that feeds the cooling medium through the stopper 12 and the shaft 16 can be adapted to the outer surface 20 of the stopper 12 or the external wall of the shaft 16, as the case may be, such that a gap is created between the external wall and the guiding device 33, through which the cooling medium 32, generally water, can flow.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. Waste heat boiler comprising:

a substantially cylindrical jacket;

a plurality of heat transfer pipes extending longitudinally within the jacket, each of the heat transfer pipes having an inlet end and an outlet end;

an axially disposed bypass pipe having an inlet end and a cone-shaped outlet end;

a coolant inlet for introducing a coolant into the jacket;

an exhaust gas stream inlet for introducing a hot exhaust gas stream into the inlet ends of the heat transfer pipes and the bypass pipe, the exhaust gas stream passing through the heat transfer pipes in an indirect heat exchange with the coolant in the jacket, producing steam and cooling the exhaust gas stream;

a coolant outlet for removing the coolant and steam;

an exhaust gas stream outlet for removing the cooled exhaust gas stream, the cooled exhaust gas stream having an exhaust temperature; and a control system controlling a gas passage velocity and quantity of the exhaust gas stream through the bypass pipe whereby the exhaust gas stream exhaust temperature is maintained within a predetermined temperature range, the control system including a stopper disposed at the outlet end of the bypass pipe, the stopper having a head plate extending into the outlet end of the bypass pipe, the stopper being axially displaceable between closed and open positions, an outer surface of the stopper head plate contacting an inner surface of the bypass pipe outlet end when the stopper is in the closed position, the inner surface of the bypass pipe outlet end and the outer surface of the stopper head plate defining a gas passage having a gas passage cross-section that increases as the stopper is axially displaced from the closed position, the stopper being cooled by a cooling medium, and a control device controlling the axial position of the stopper.

2. Waste heat boiler according to claim 1, wherein the stopper includes a base plate disposed opposite to the head plate, the base plate deflecting the exhaust gas stream at the stopper in a radial direction.

3. Waste heat boiler according to claim 2, wherein the stopper head plate and the stopper base plate each have an outer diameter, the outer diameter of the stopper base plate being at least 1.5 times the outer diameter of the stopper head plate.

4. Waste heat boiler according to claim 1, wherein the outer surface of a center portion of the stopper has a substantially cylindrical length.

5. Waste heat boiler according to claim 1, wherein the outer surface of a center portion of the stopper has a substantially conic length.

6. Waste heat boiler according to claim 5, wherein the conic length of the stopper center portion has a taper that corresponds to a taper of the cone-shaped outlet end of the bypass pipe.

7. Waste heat boiler according to claim 5, wherein the conic length of the stopper center portion has a taper that deviates in relation to a taper of the cone-shaped outlet end of the bypass pipe, whereby, viewed in a flow direction of the exhaust gas stream, the taper of the conic length of the stopper center portion diverges from the taper of the outlet end of the bypass pipe.

8. Waste heat boiler according to claim 1, wherein the control system also includes a shaft connected to the stopper, the cooling medium being transported to the stopper through the shaft.

9. Waste heat boiler according to claim 8, wherein the stopper and the shaft are cooled only for one-way cooling, the cooling medium being discharged from the stopper into the exhaust gas stream after passing through the shaft and the stopper.

10. Waste heat boiler according to claim 8, wherein the stopper and shaft each have an outer wall and the control system also includes a guiding device adapted to the stopper outer wall and the shaft outer wall, defining a gap between the outer walls and the guiding device through which the cooling medium is transported.

11. Waste heat boiler according to claim 1, wherein the cone-shaped outlet end of the bypass pipe has an interior lining.

12. Waste heat boiler according to claim 1, wherein the heat transfer pipes and the bypass pipe have internal diameters, the internal diameter of the bypass pipe being greater that the internal diameter of each of the heat transfer pipes.

* * * * *